US012672703B2

(12) United States Patent
Selvi

(10) Patent No.: US 12,672,703 B2
(45) Date of Patent: Jul. 7, 2026

(54) ARTICLE OF LUGGAGE WITH EXTERIOR POCKETS IN A MOULDED PORTION

(71) Applicant: IT LUGGAGE LIMITED, Hertford (GB)

(72) Inventor: Sedat Selvi, Hertford (GB)

(73) Assignee: IT LUGGAGE LIMITED, Hertford (GB)

( * ) Notice: Subject to any disclaimer, the term of this patent is extended or adjusted under 35 U.S.C. 154(b) by 80 days.

(21) Appl. No.: 18/254,028

(22) PCT Filed: Nov. 16, 2021

(86) PCT No.: PCT/EP2021/081840
§ 371 (c)(1),
(2) Date: May 23, 2023

(87) PCT Pub. No.: WO2022/112056
PCT Pub. Date: Jun. 2, 2022

(65) Prior Publication Data

US 2024/0023684 A1 Jan. 25, 2024

(30) Foreign Application Priority Data

Nov. 24, 2020 (GB) ..... 2018473
Apr. 13, 2021 (GB) ..... 2105260

(51) Int. Cl.
*A45C 5/06* (2006.01)
*A45C 5/03* (2006.01)
(Continued)

(52) U.S. Cl.
CPC ..... *A45C 5/06* (2013.01); *A45C 5/03* (2013.01); *A45C 5/14* (2013.01); *A45C 13/005* (2013.01);
(Continued)

(58) Field of Classification Search
CPC .... A45C 5/06; A45C 5/03; A45C 5/14; A45C 13/005; A45C 13/103; A45C 2005/037
(Continued)

(56) References Cited

U.S. PATENT DOCUMENTS 5,676,223 A * 10/1997 Cunningham ..... A45C 5/06 190/110
2005/0133558 A1* 6/2005 Toombs ..... A45C 13/002 224/576
(Continued)

FOREIGN PATENT DOCUMENTS

CN 1770995 A 5/2006
CN 103355904 A 10/2013
(Continued)

OTHER PUBLICATIONS

PCT Search Report and Written Opinion prepared for PCT Application No. PCT/EP2021/081840, completed Feb. 22, 2022.
(Continued)

*Primary Examiner* — Don M Anderson
*Assistant Examiner* — Jessica Kavini Tamil
(74) *Attorney, Agent, or Firm* — Barnes & Thornburg LLP

(57) ABSTRACT

An article of luggage with exterior pockets in a moulded portion An article of luggage comprising: a body having an interior defining a body containment volume accessible through a body opening; a lid comprising a moulded concave shell having an interior defining a lid containment volume accessible through a lid opening extending in a lid
(Continued)

opening plane; and a hinge between the body and the lid to enable movement of the lid relative to the body between: an open position in which the body and lid containment volumes are accessible through the body and lid openings; and a closed position in which the body and the lid openings cooperate such that the body and lid containment portions are enclosed. The moulded concave shell comprises: a lower protruded portion which protrudes from the lid opening plane via a lower stepped portion; an upper protruded portion which protrudes from the lid opening plane via an upper stepped portion that faces the lower stepped portion. The moulded concave shell further comprises a first aperture that provides access to a lower pocket within the lid containment volume behind the lower protruded portion; and a second aperture that provides access to an upper pocket within the lid containment volume behind the upper protruded portion, wherein the upper pocket is in part bounded by an interior surface of the upper stepped portion.

20 Claims, 9 Drawing Sheets

(51) Int. Cl.
*A45C 5/14* (2006.01)
*A45C 13/00* (2006.01)
*A45C 13/10* (2006.01)

(52) U.S. Cl.
CPC ..... *A45C 13/103* (2013.01); *A45C 2005/037* (2013.01)

(58) Field of Classification Search
USPC ..... 190/18 A
See application file for complete search history.

(56) References Cited

U.S. PATENT DOCUMENTS

| | | | | |
|---|---|---|---|---|
| 2006/0243550 | A1 | 11/2006 | Morszeck | |
| 2007/0033734 | A1* | 2/2007 | Gooddine | A47G 9/0253 5/636 |
| 2011/0186396 | A1 | 8/2011 | Sheikh | |
| 2016/0174673 | A1 | 6/2016 | Lai | |
| 2020/0000192 | A1* | 1/2020 | Kim | A45C 13/04 |
| 2020/0352292 | A1* | 11/2020 | Naparstek | A45C 5/03 |
| 2022/0087382 | A1* | 3/2022 | Zheng | A45C 5/03 |

FOREIGN PATENT DOCUMENTS

| | | |
|---|---|---|
| FR | 3033127 | 9/2016 |
| GB | 2580666 | 7/2020 |
| JP | 3213778 | 11/2017 |

OTHER PUBLICATIONS

Combined Search and Examination Report prepared for United Kingdom Patent Application No. GB2018473.5, completed Mar. 16, 2021.

Combined Search and Examination Report prepared for United Kingdom Patent Application No. GB2105260.0, completed Aug. 20, 2021.

Communication under Rule 71(3) EPC for European Patent Application No. 21 815 956.4-1015; dated Apr. 9, 2025 (35 pages).

Office Action issued by the Chinese Patent Office for Chinese Patent Application No. 202180079094.4, on Jul. 28, 2025, and its English translation (14 pages).

Second Notice of Examination issued by the Chinese Intellectual Property Office on Mar. 13, 2026, for Chinese Patent Application No. 202180079094.4, and its English translation (16 pages).

* cited by examiner

ARTICLE OF LUGGAGE WITH EXTERIOR POCKETS IN A MOULDED PORTION

CROSS-REFERENCE TO RELATED APPLICATIONS

This application is the U.S. national phase of PCT/EP2021/081840, filed on Nov. 16, 2021, which claims the benefit of United Kingdom Patent Application Number 2018473.5, filed on Nov. 24, 2020 and United Kingdom Patent Application Number 2105260.0, filed on Apr. 13, 2021, the entire disclosures of all of which are hereby incorporated by reference herein.

TECHNICAL FIELD

The disclosure relates to the field of luggage, such as suitcases, comprising at least one moulded shell.

BACKGROUND

One advantage of luggage that comprises at least one moulded shell is that the moulded shell provides more protection to contents of the luggage than a fabric alternative. Furthermore, by contrast with fabric, a moulded shell retains its shape without the need for other structure-defining elements.

In fabric luggage, fabric panels may be fastened together in order to achieve a three-dimensional form. Such fastening is generally straightforward, for example by stitching. By contrast, it is more complex to fasten single piece moulded portions to other elements and, in any case, it is not necessary to do so in order to obtain a three-dimensional form since the moulded portion itself provides the three-dimensional form.

GB 2580666, in common ownership with the present disclosure, discloses a moulded luggage shell with an exterior fabric panel. However, the protective advantages of the moulded shell do not provide protection to the contents of the pocket since the exterior surface of the pocket is fabric.

SUMMARY OF THE DISCLOSURE

Against this background there is provided an article of luggage comprising:

- a body having an interior defining a body containment volume accessible through a body opening;
- a lid comprising a moulded concave shell having an interior defining a lid containment volume accessible through a lid opening extending in a lid opening plane; and
- a hinge between the body and the lid to enable movement of the lid relative to the body between: an open position in which the body and lid containment volumes are accessible through the body and lid openings; and a closed position in which the body and the lid openings cooperate such that the body and lid containment portions are enclosed; wherein:

wherein the moulded concave shell comprises:

- a lower protruded portion which protrudes from the lid opening plane via a lower stepped portion;
- an upper protruded portion which protrudes from the lid opening plane via an upper stepped portion that faces the lower stepped portion;
- a first aperture that provides access to a first pocket within the lid containment volume behind the lower protruded portion; and

- a second aperture that provides access to an upper pocket within the lid containment volume behind the upper protruded portion, wherein the upper pocket is in part bounded by an interior surface of the second stepped portion.

In this way, advantages of a moulded portion for protection of suitcase contents can be exploited in the context of pockets accessible from an exterior of the article of luggage without having to open the lid of the article of luggage. Furthermore, the interior surface of the second stepped portion provides a moulded surface at a lower edge of the upper pocket which enables use of the moulded lid shell for protection of contents at the lower edge of the upper pocket.

Optionally, the upper and lower stepped portions are substantially perpendicular to the lid opening plane. Optionally, the lower stepped portion may comprise the first aperture. In this way, the first aperture may be less obvious, less accessible for swift access by a third party, and more protected from damage.

The moulded concave shell may further comprise a first recessed portion between the upper and lower stepped portions and set back from the upper and lower protruded portions.

The concave moulded shell may further comprise a second recessed portion that is set back from the upper protruded portion and substantially perpendicular to the lid opening plane, and a top stepped portion on an opposite side of the upper protruded portion from the upper stepped portion, wherein the second aperture is located in the top stepped portion. In this way, the second aperture may be less obvious, less accessible for swift access by a third party, and more protected from damage.

The lower pocket may comprises a first fabric receptacle having a first receptacle opening, the first receptacle opening having a first side and a second side, wherein the first side of the first receptacle opening is fastened to the moulded shell on a first side of the first aperture and the second side of the first receptacle opening is fastened to the moulded shell on a second side of the first aperture. In this way, the fabric receptacle may prevent significant movement of contents of the pocket within the moulded shell.

The first receptacle opening may be closable by a first pocket zipper having a first zipper tape on the first side of the first receptacle opening and a second zipper tape on the second side of the first receptacle opening, such that both the first aperture and the fabric receptacle are openable and closable by the first pocket zipper.

The first zipper tape may be fastened to the moulded shell by stitching and the second zipper tape is fastened to the moulded shell by stitching. In this way, one zipper provides the functionality to close the aperture and the pocket.

The upper pocket may comprise a second fabric receptacle having a second receptacle opening, the second receptacle opening having a first side and a second side, wherein the first side of the second receptacle opening is fastened to the second moulded shell on a first side of the second aperture and the second side of the second receptacle opening is fastened to the second moulded shell on a second side of the second aperture.

The second receptacle opening may be closable by an upper pocket zipper having a primary zipper tape on the first side of the second receptacle opening and a secondary zipper tape on the second side of the second receptacle opening, such that both the second aperture and the second fabric receptacle are openable and closable by the second pocket zipper. In this way, one zipper provides the functionality to close the aperture and the pocket.

The article of luggage may further comprise a lid liner fastened to the second moulded portion within and proximate the lid opening such that the first fabric receptacle and, where present, the second receptacle are located between the lid liner and the moulded portion. In this way, further restriction of movement of pocket contents may be provided.

The article of luggage may further comprise a body liner fastened to the body within and proximate the body opening.

Optionally, in the closed position in which the body and the lid openings cooperate such that the body and lid containment portions are enclosed, cooperation is provided by a primary zipper comprising a first tape fastened to the first moulded portion proximate the base opening and a second tape fastened to the second moulded portion proximate the lid opening.

The article of luggage may further comprise a plurality of protruding wheel systems, each comprising at least one wheel, wherein each protruding wheel system is fastened to an exterior of the first moulded portion.

Each wheel system may comprise a connection element and a wheel unit, wherein the wheel unit is rotatable relative to the connection element about a generally vertical axis that sits outside a footprint of the base.

Optionally, the article of luggage may be is in the form of a suitcase.

In a further aspect of the disclosure there is provided a method of manufacturing an article of luggage, the article of luggage comprising:

- a body having an interior defining a body containment volume accessible through a body opening;
- a lid comprising a moulded concave shell having an interior defining a lid containment volume accessible through a lid opening extending in a lid opening plane;

the method comprises:

- moulding the lid comprising a concave shell to include:
  - a lower protruded portion which protrudes from the lid opening plane via a lower stepped portion;
  - an upper protruded portion which protrudes from the lid opening plane via an upper stepped portion that faces the lower stepped portion;
- making an incision to provide a first aperture in the moulded concave shell that provides access to a lower pocket within the lid containment volume behind the lower protruded portion;
- making an incision to provide a second aperture in the moulded concave shell that provides access to an upper pocket within the lid containment volume behind the upper protruded portion, wherein the upper pocket is in part bounded by an interior surface of the upper stepped portion;
- fastening a hinge between the body and the lid to enable movement of the lid relative to the body between: an open position in which the body and lid containment volumes are accessible through the body and lid openings; and a closed position in which the body and the lid openings cooperate such that the body and lid containment portions are enclosed.

In this way, straightforward manufacture of an article of luggage comprising a moulded top with exterior accessible pockets may be provided.

The method may further comprise:

- providing a first fabric receptacle having a first receptacle opening the first receptacle opening having a first side and a second side;
- fastening the first side of the first receptacle to the moulded shell on a first side of the first aperture;
- fastening the second side of the first receptacle to the moulded shell on a second side of the first aperture.

The method may further comprise: fastening a first pocket zipper having a first zipper tape and a second zipper tape to the lid, wherein the first zipper tape is fastened on the first side of the first receptacle opening and the second zipper tape is fastened on the second side of the first receptacle opening, such that both the first aperture and the fabric receptacle are openable and closable by the first pocket zipper.

Optionally, any one or more of the fastening steps of the method comprises stitching.

BRIEF DESCRIPTION OF THE DRAWINGS

The invention may be put into practice in a number of ways and specific embodiments will now be described by way of example only and with reference to the Figures in which.

DETAILED DESCRIPTION

Figure 1:
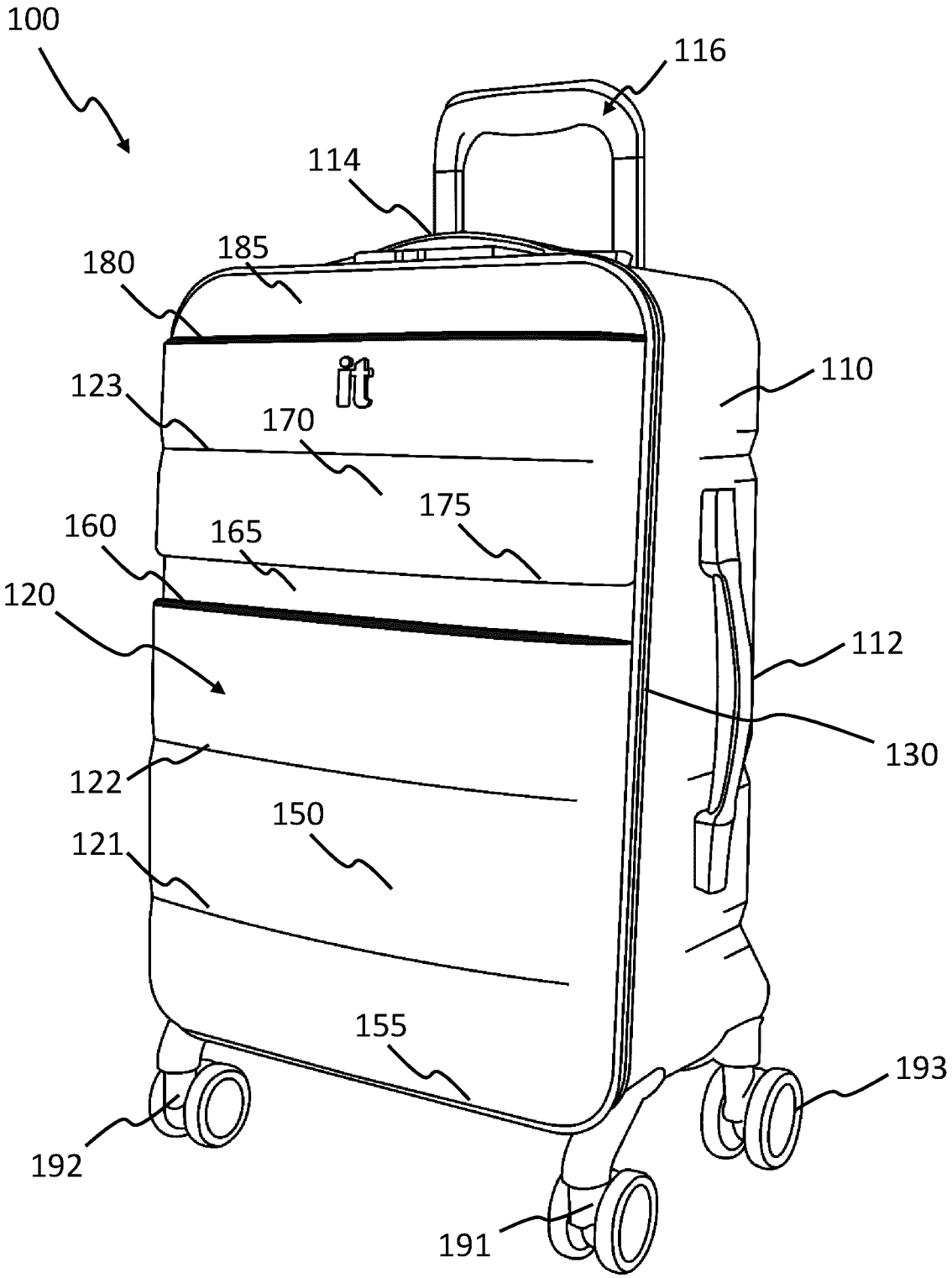
FIG. 1 shows a perspective view of a first embodiment of a suitcase in accordance with the present disclosure.
Figure 2:
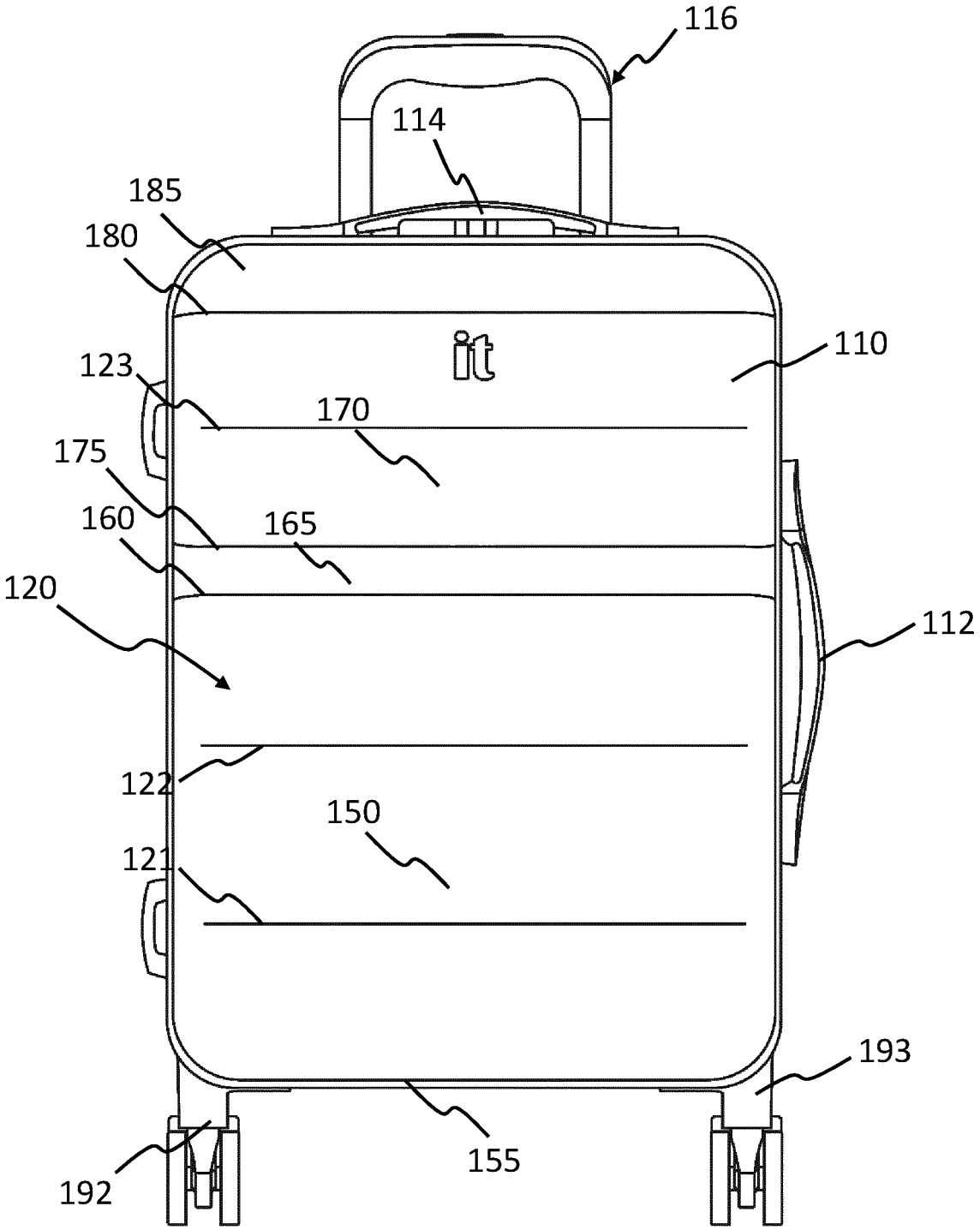
FIG. 2 shows a front view of the suitcase of FIG. 1.

FIG. 1 is a schematic diagram of an article of luggage, specifically a suitcase 100, according to a first embodiment of the disclosure.

Figure 3:
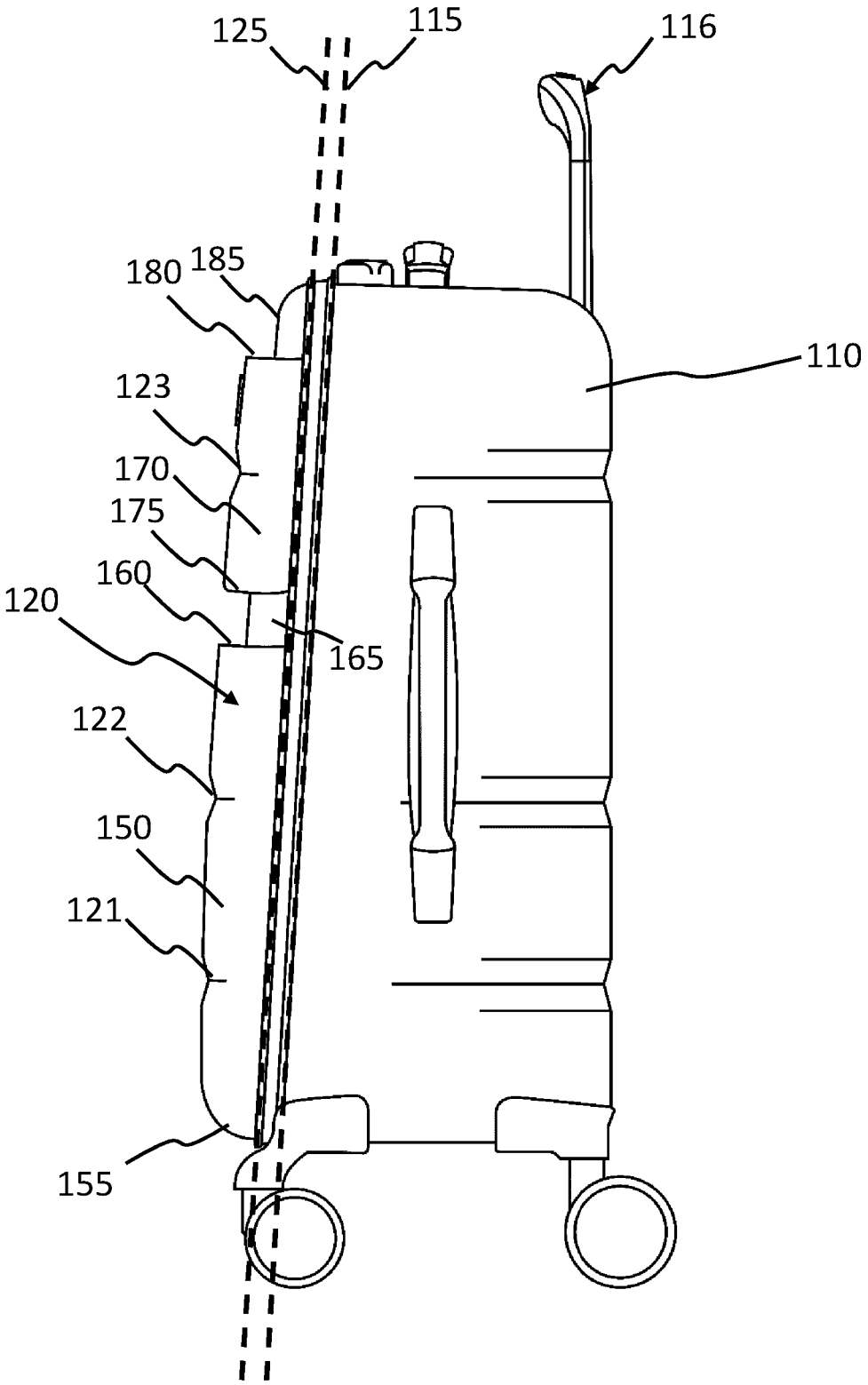
FIG. 3 shows a side view of the suitcase of FIG. 1.
Figure 4:
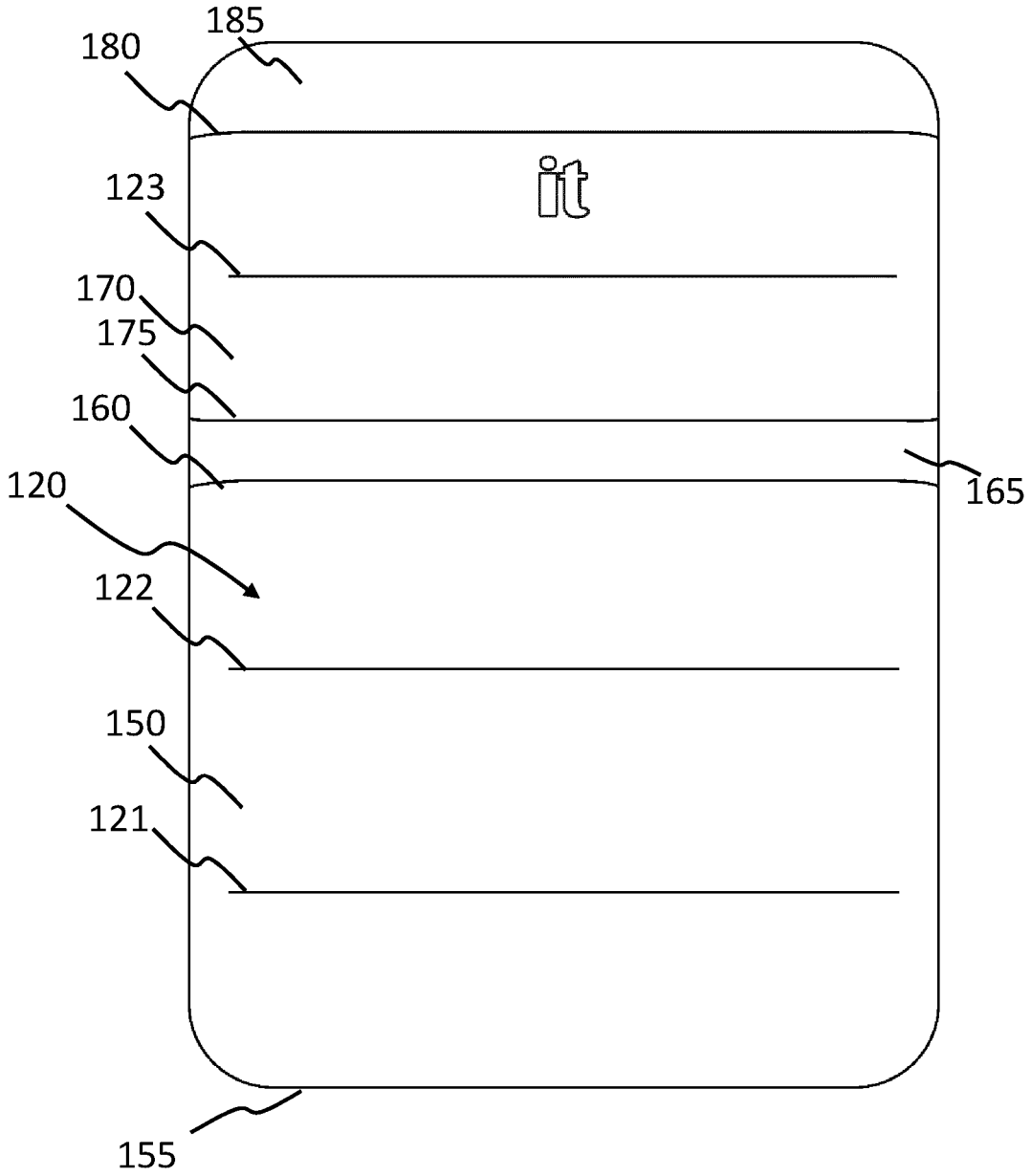
FIG. 4 shows a front view of the moulded lid panel of the suitcase of FIG. 1.
Figure 5:
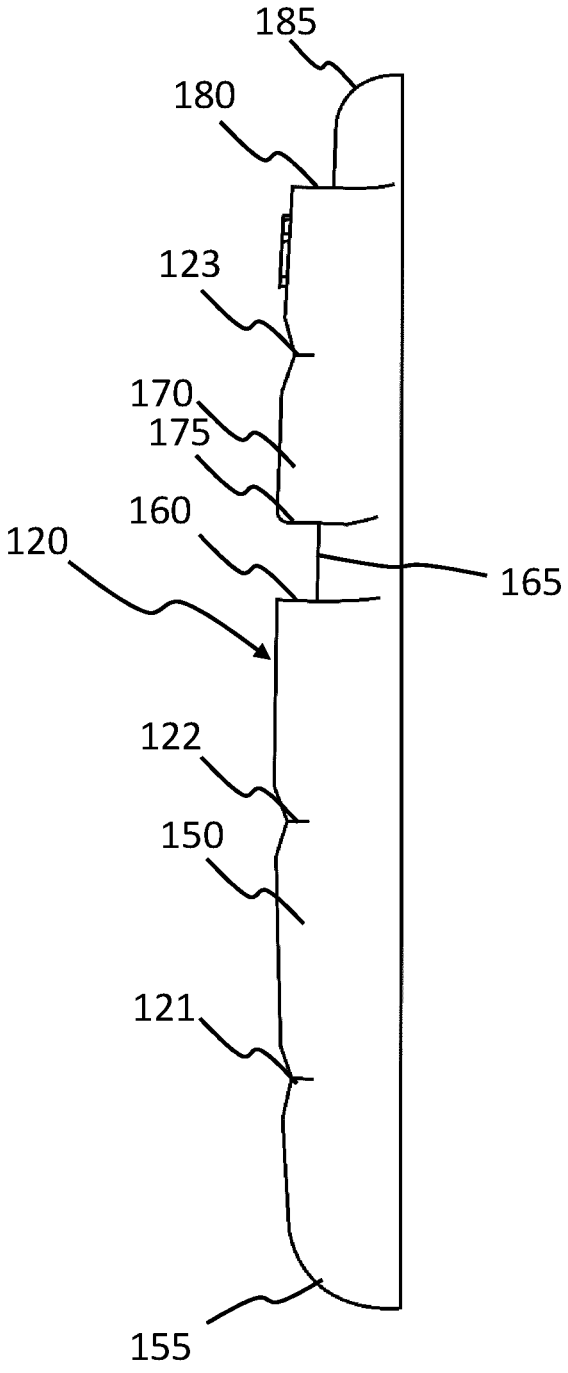
FIG. 5 shows a side view of the moulded lid panel of FIG. 4.

The suitcase 100 comprises a body 110 having an interior defining a body containment volume accessible through a body opening (extending in a body opening plane 115, labelled in FIG. 3). The suitcase 100 comprises a lid 120 having an interior defining a lid containment volume accessible through a lid opening extending in a lid opening plane (extending in a lid opening plane 125).

The body 110 is hingedly attached to the lid 120 to enable movement of the lid 120 relative to the body 110 between an open position and a closed position.

In the closed position, the body opening meets the lid opening such that the body opening plane 115 and the lid opening plane 125 are parallel. A principal zipper 130, located between the lid opening plane and the body opening plane, may be used to fasten the lid 120 proximate the lid opening to the body 110 proximate the body opening. The principal zipper 130 may comprise a first zipper tape fastened to the body 110 around the body opening and a second zipper tape fastened to the lid 120 around the lid opening.

The lid 120 comprises a first moulded shell. The first moulded shell provides for a three-dimensional structure without the need for separate shape defining elements.

In a first option, the body 110 may comprise a second moulded shell. The second moulded shell provides a three-dimensional structure without the need for separate shape defining elements. The moulded shell may be of a hard material which does not substantially yield under pressure or of a soft material which yields to some degree under pressure.

In a second option, the body 110 may comprise a fabric exterior with an interior shape defining skeleton.

With reference to FIG. 1, the body 110 comprises a side handle 112, a top handle 114 and a retractable handle assembly 116. The body 110 further comprises a first wheel assembly 191, a second wheel assembly 192, a third wheel assembly 193 and a fourth wheel assembly 194 (not visible in FIG. 1). Each of the first, second, third and fourth wheel assemblies 191, 192, 193, 194 is located in one of four corners of a lower surface of the body 110. Each wheel assembly 191, 192, 193, 194 comprises: an arm that extends between its corner of the lower surface of the body 110 to a location outside a footprint of the body 110. This leads to increased stability relative to wheel assemblies that are solely located within the footprint of the body 110. Each wheel assembly 191, 192, 193, 194 further comprises a pair of wheels, one on each side of the arm. The pair of wheels together is configured to rotate around a vertical axis provided by a rotatable stem that projects beneath the arm. Each wheel of the pair of wheels is also configured to rotate around a horizontal axis that extends through the rotatable stem. In this way, the suitcase is highly maneuverable.

With reference to FIG. 3, the lid 120 comprises a lower protruded portion 150 that extends substantially out from the lid opening plane 125 and an upper protruded portion 170 that also extends substantially out from the lid opening plane 125. The lower protruded portion 150 comprises a lower edge 155 via which the lower protruded portion 150 projects from the lid opening plane 125 at a lower end of the lower protruded portion 150. The lid 120 comprises a first recessed portion 165 between the lower protruded portion 150 and the upper protruded portion 170, wherein the first recessed portion 165 extends out from the lid opening plane 125 to a lesser degree than the lower protruded portion 150 and the upper protruded portion 170. The lid 120 also comprises a lower stepped portion 160 that extends between the lower protruded portion 150 and the first recessed portion 165 and that is substantially perpendicular to the lid opening plane 125. The lid 120 also comprises an upper stepped portion 175 that extends between the upper protruded portion 170 and the first recessed portion 165 and that is substantially perpendicular to the lid opening plane 125. In this way, the first recessed portion 165 is located between the upper and lower stepped portions 175, 160 and set back from the upper and lower protruded portions 170, 150.

Figure 6:
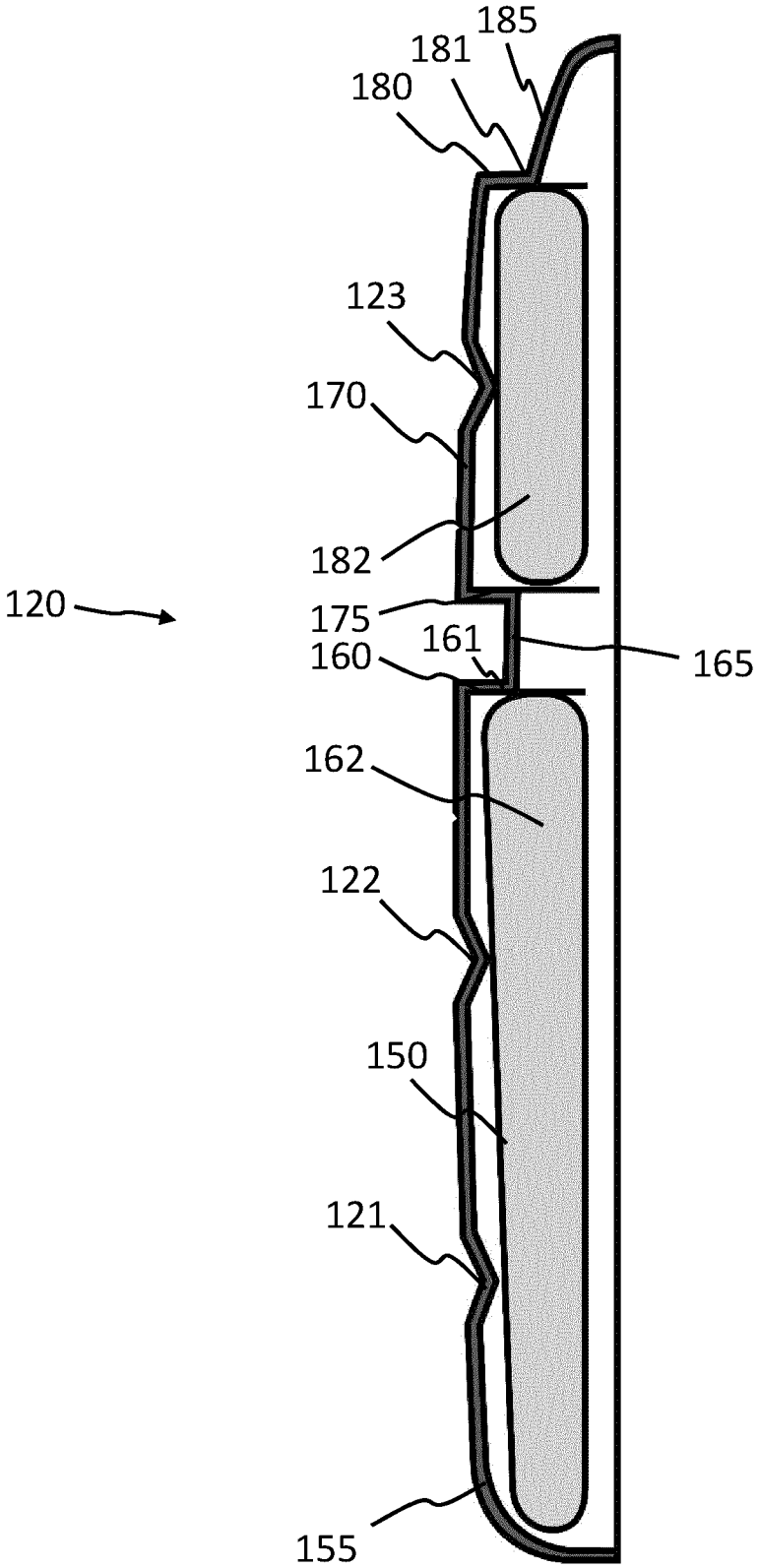
FIG. 6 a cross sectional view through the moulded lid panel of FIG. 5.
Figure 7:
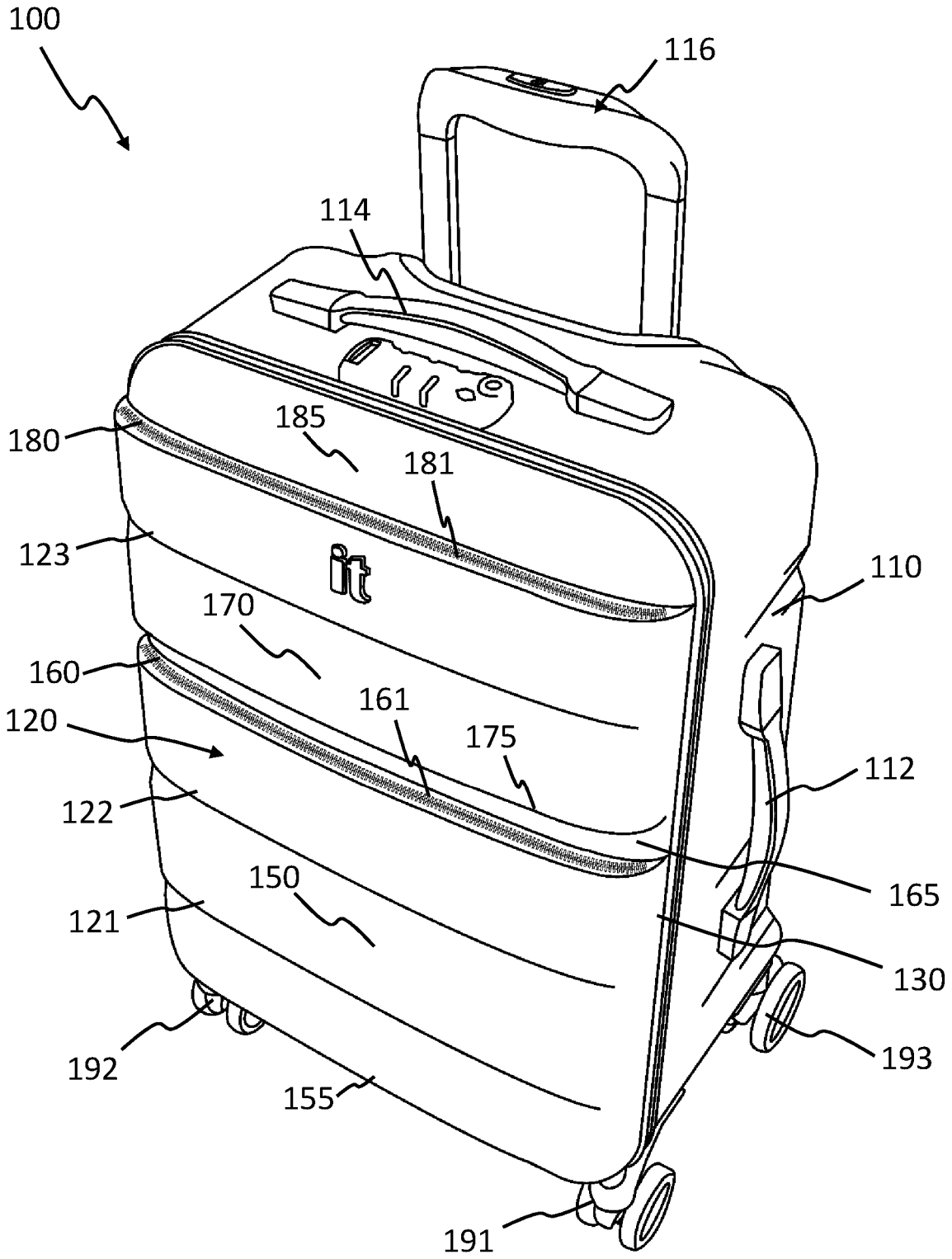
FIG. 7 shows a perspective view of the suitcase of FIG. 1 looking from above.

With reference to FIG. 6, a first aperture 161 is located in the lower stepped portion 160. The first aperture 161 provides access to a lower pocket 162 that is located within the lid containment volume behind the lower protruded portion 150.

The lower pocket 162 comprises a first fabric receptacle having a first receptacle opening, the first receptacle opening having a first side and a second side. The first side is fastened to the moulded shell on a first side of the first aperture towards a front of the first recessed portion 165 and the second side of the first receptacle opening is fastened to the moulded shell on a second side of the first aperture towards a rear of the first recessed portion 165.

The first receptacle opening is closable by a first pocket zipper having a first zipper tape on the first side of the first receptacle opening and a second zipper tape on the second side of the first receptacle opening, such that both the first aperture 161 and the first fabric receptacle are openable and closable by the first pocket zipper.

The first zipper tape may be fastened to the moulded shell by stitching and the second zipper tape may be fastened to the moulded shell by stitching.

In this way the stitching of the first zipper tape and the second zipper tape to the moulded shell not only provides the functionality of opening and closing the lower pocket 162 via the first pocket zipper but also provides the functionality of retaining the first fabric receptacle in position.

It may be that the first fabric receptacle is not otherwise fastened to the first moulded shell. This reduces manufacturing steps and costs.

The lid containment volume may be provided with a fabric lining such that the first fabric receptacle may be located between the moulded lid and the fabric lining so as to provide some restriction of movement of the first fabric receptacle beyond the stitching around the zipper tapes.

By providing the first aperture 161 in the lower stepped portion 160, it more discrete than would be the case if it were in the front face and also the stitching and zipper is less vulnerable to damage from handling such as in airport luggage handling areas. Furthermore, the lower pocket 162 lends itself well to receiving and accommodating the kinds of items, like laptop computers and tablets, that travelers like to be accessible in an exterior pocket rather than in the main body of the luggage.

The body containment volume may also be provided with a fabric lining to complement the fabric lining of the lid containment volume.

The lid 120 comprises a second recessed portion 185 between the upper protruded portion 170 and a top edge of the lid 120. The lid 120 also comprises a top stepped portion 180 that is substantially perpendicular to the lid opening plane 125. The second recessed portion 185 extends out from the lid opening plane 125 to a lesser degree than the lower protruded portion 150 and the upper protruded portion 170.

A second aperture 181 is located in the top stepped portion 180. With reference to FIG. 6, the second aperture 181 provides access to an upper pocket 182 that is located within the lid containment volume behind the upper protruded portion 170. A lower portion of the upper pocket 182 is in part bounded by an interior surface of the upper stepped portion 175. In this way, items at the bottom of the upper pocket 182 benefit from protection provided by the moulded material of the upper stepped portion 175 of the moulded shell of the lid 120.

The upper pocket 182 comprises a second fabric receptacle having a second receptacle opening, the second receptacle opening having a first side and a second side. The first side is fastened to the moulded shell on a first side of the second aperture 181 towards a front of the second recessed portion 185 and the second side of the second receptacle opening is fastened to the moulded shell on a second side of the second aperture 181 towards a rear of the second recessed portion 185.

The second receptacle opening is closable by a second pocket zipper having a primary zipper tape on the first side of the second receptacle opening and a secondary zipper tape on the second side of the second receptacle opening, such that both the second aperture and the second fabric receptacle are openable and closable by the second pocket zipper.

The primary zipper tape may be fastened to the moulded shell by stitching and the secondary zipper tape may be fastened to the moulded shell by stitching.

In this way the stitching of the primary zipper tape and the secondary zipper tape to the moulded shell not only provides the functionality of opening and closing the upper pocket via the second pocket zipper but also provides the functionality of retaining the second fabric receptacle in position.

The second fabric receptacle may be not otherwise fastened to the first moulded shell. This reduces manufacturing steps and costs. If the lid containment volume is provided with a fabric lining then the second fabric receptacle may be located between the moulded lid and the fabric lining so as to provide some restriction of movement of the second fabric receptacle beyond the stitching around the zipper tapes.

By providing the second aperture 181 in the top stepped portion 180, it more discrete than would be the case if it were in the front face and also the stitching and zipper is less vulnerable to damage from handling such as in airport luggage handling areas.

Furthermore, the upper pocket 182 lends itself well to receiving and accommodating the kinds of items, like laptop computers and tablets, that travelers like to be accessible in an exterior pocket rather than in the main body of the luggage.

The lid 120 may further comprise a plurality of strengthening ribs 121, 122, 123 in the form of shallow linear indentations in a front surface of the lid. In the first embodiment of the suitcase 100 according to the disclosure, the strengthening ribs 121, 122, and 123 are all perpendicular to the sides of the suitcase.

In alternative arrangements, the first aperture 161 and/or the second aperture 181 are located elsewhere on the moulded lid portion.

In alternative arrangements, closure of the lower pocket 162 and the upper pocket 182 may be provided other than by zippers. For example, closure may be provided by one or more of the following: a magnetic clasp, a button tab, a snap fastener, or any other suitable closure.

Figure 8:
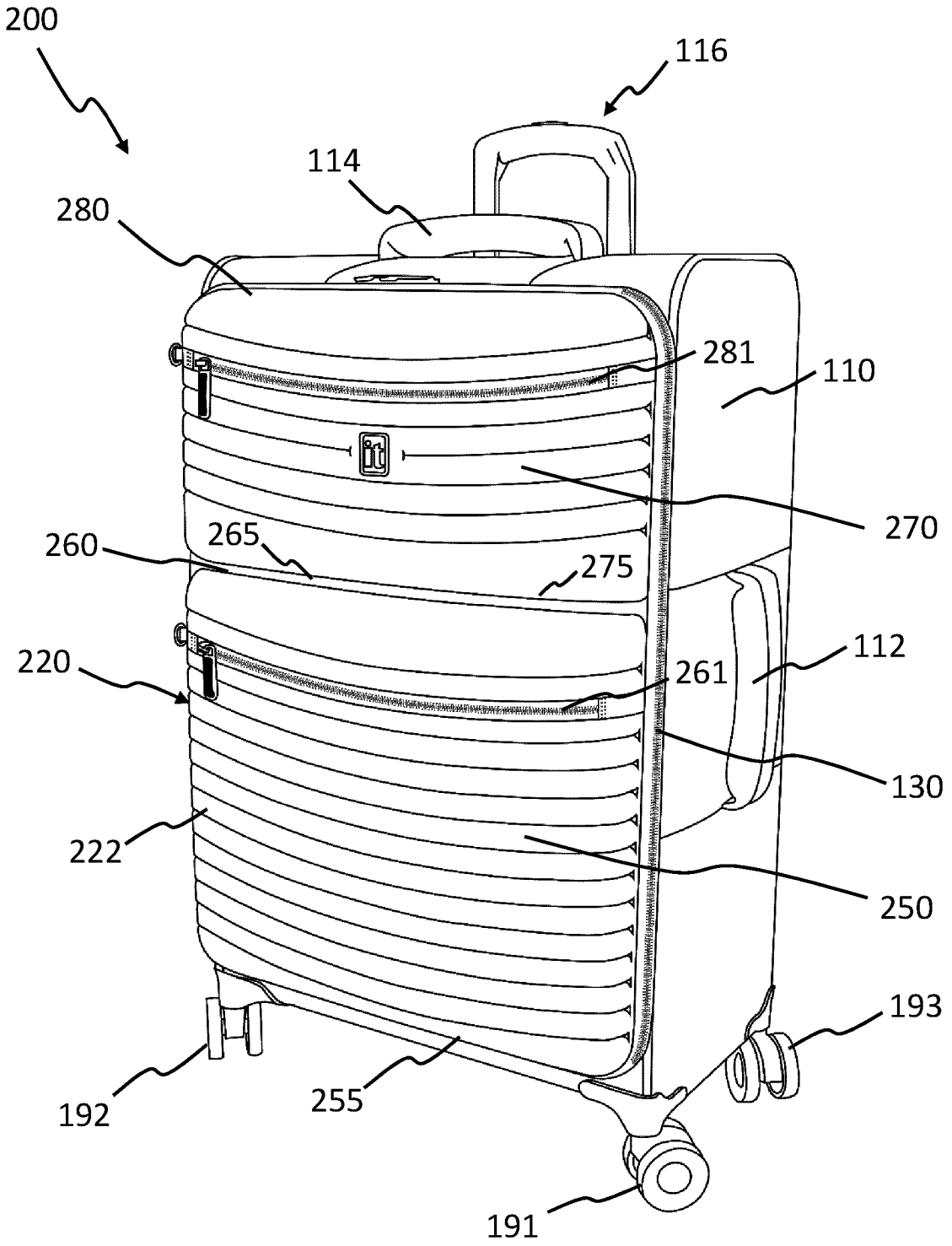
FIG. 8 shows a perspective view of a second embodiment of a suitcase in accordance with the present disclosure.
Figure 9:
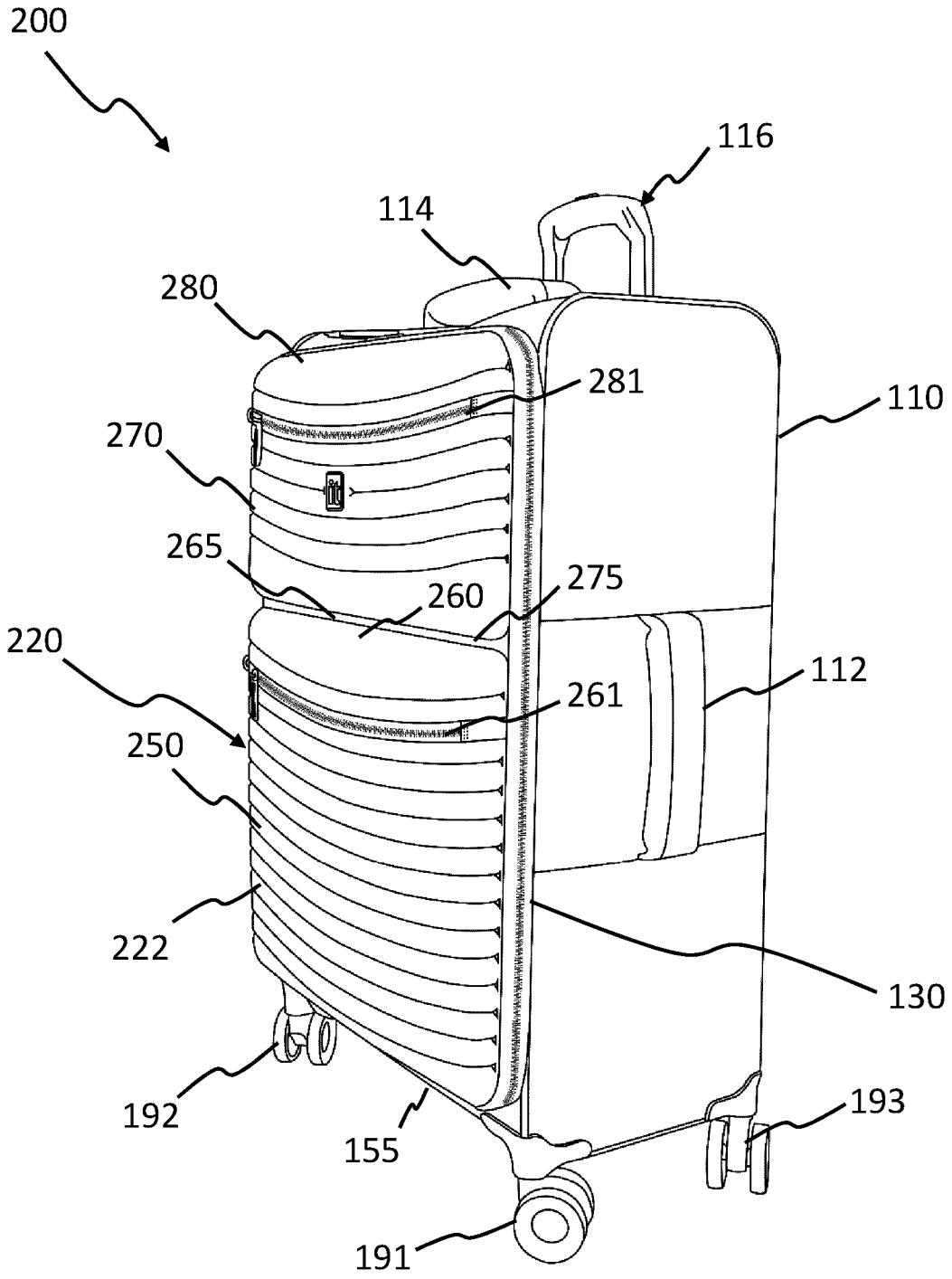
FIG. 9 shows a further perspective view of the suitcase of FIG. 8.

FIGS. 8 and 9 are schematic diagrams of an article of luggage, specifically a suitcase 200, according to a second embodiment of the disclosure.

The suitcase 200 of the second embodiment differs from the suitcase 100 of the first embodiment in a number of ways. The description that follow focuses on the differences relative to the suitcase 100 of the first embodiment.

The suitcase 200 comprises a first protruded portion 250 and a second protruded portion 270 both of which extend substantially out from the opening plane of the lid 220. Whereas for the suitcase 100 of the first embodiment the first aperture 161 is located on the lower stepped portion 160, in the suitcase 200 of the second embodiment the first aperture 261 is located on a front face of the first protruded portion 250. Similarly, the second aperture 281 of the suitcase 200 is located on a front face of the second protruded portion 270 rather than on the top stepped portion 180.

Secondly, the lower stepped portion 260, the upper stepped portion 275 and the top stepped portion 280 protrude from the opening plane of the lid 220 at a gentle acute angle, whereas the equivalent stepped portions in the suitcase 100 project at an angle that is approximately perpendicular to the lid opening plane.

Furthermore, there is no distinct change in radius between the lower stepped portion 260 and a front face of the first protruded portion 250. Rather, the radius is fairly continuous. Similarly, there is no distinct change in radius between the upper stepped portion 275 and the front face of the second protruded portion 270 or between the top stepped portion 280 and the front face of the second protruded portion 270.

Also, relative to the suitcase 100 of the first embodiment, there is a larger radius between the lower edge 255 of the first protruded portion 250 and the front face of the first protruded portion 250.

In this way, the overall profile of the font face when viewed from the side avoids the appearance of corners between the first protruded portion 250, the first recess 265 and the second protruded portion 270.

Finally, the suitcase 200 comprises a larger number of strengthening ribs 222 than the suitcase 100 of the first embodiment. Moreover, the strengthening ribs 222 are curved. In addition, the first aperture 261 and the second aperture 281 are parallel to the curves of the strengthening ribs 222.

Alternative strengthening rib configurations and aperture configurations fall within the scope of the disclosure. For example, the apertures and/or the strengthening ribs may be inverted relative to what is shown in FIGS. 8 and 9. The apertures may or may not be parallel to the ribs. Furthermore different aperture shapes are possible, including n-shaped, and u-shaped.

Also falling within the scope of the disclosure are embodiments having more than two protruded portions thus providing more than two pockets.

In addition, the moulded concave shell may comprise embossing for either or both of structural and aesthetic reasons.

In a further aspect of the disclosure there is provided a method of manufacturing an article of luggage in accordance with the disclosure.

The method comprises moulding the lid 120 comprising a concave shell to include a lower protruded portion 150 which protrudes from the lid opening plane 125 via a lower stepped portion 160 and an upper protruded portion 170 which protrudes from the lid opening plane 125 via an upper stepped portion 175 that faces the lower stepped portion 160.

The method further comprises making an incision to provide a first aperture in the moulded concave shell that provides access to the lower pocket within the lid containment volume behind the lower protruded portion. The method further comprises making an incision to provide a second aperture in the moulded concave shell that provides access to an upper pocket within the lid containment volume behind the upper protruded portion, wherein the upper pocket is in part bounded by an interior surface of the upper stepped portion.

The method further comprises fastening a hinge between the body and the lid to enable movement of the lid relative to the body between: an open position in which the body and lid containment volumes are accessible through the body and lid openings; and a closed position in which the body and the lid openings cooperate such that the body and lid containment portions are enclosed.

In some embodiments, the upper and lower stepped portions are substantially perpendicular to the lid opening plane.

In some embodiments, the moulded concave shell further comprises a first recessed portion between the upper and lower stepped portions and set back from the upper and lower protruded portions.

In some embodiments, the concave moulded shell further comprises a second recessed portion that is set back from the upper protruded portion and substantially perpendicular to the lid opening plane, and a top stepped portion on an opposite side of the upper protruded portion from the upper stepped portion, wherein the second aperture is located in the top stepped portion.

In some embodiments, the method also comprises providing a first fabric receptacle having a first receptacle opening the first receptacle opening having a first side and a second side, then fastening the first side of the first receptacle to the moulded shell on a first side of the first aperture and fastening the second side of the first receptacle to the moulded shell on a second side of the first aperture.

The method may further comprise: fastening a first pocket zipper having a first zipper tape and a second zipper tape to the lid. In particular, the first zipper tape may be fastened on the first side of the first receptacle opening and the second zipper tape may be fastened on the second side of the first receptacle opening, such that both the first aperture and the fabric receptacle are openable and closable by the first pocket zipper.

In some embodiments, any one or more of the fastening steps may comprise stitching.

The invention claimed is:

1. An article of luggage comprising:

a body having an interior defining a body containment volume accessible through a body opening;

a lid comprising a single-piece moulded concave shell having an interior defining an entirety of a lid containment volume accessible through a lid opening extending in a lid opening plane; and the body and the lid being coupled together to enable movement of the lid relative to the body between: an open position in which the body and lid containment volumes are accessible through the body and lid openings; and a closed position in which the body and the lid openings cooperate such that the body and lid containment portions are enclosed; wherein:

the single-piece moulded concave shell comprises:

a lower protruded portion which protrudes from the lid opening plane via a lower stepped portion;

an upper protruded portion which protrudes from the lid opening plane via an upper stepped portion that faces the lower stepped portion;

a first aperture formed by a first incision in the single-piece moulded concave shell, wherein the first aperture provides access to a lower pocket portion forming a first pocket space that is part of the entirety of the lid containment volume behind the lower protruded portion and contiguous with all other portions of the lid containment volume, wherein a lower pocket comprises a first fabric receptacle having a first opening with sides that are permanently affixed to the single-piece moulded concave shell on opposite sides of the first incision forming the first aperture so that the first fabric receptacle is contained at least in part within the lower protruded portion of the single-piece moulded concave shell; and a second aperture formed by a second incision in the single-piece moulded concave shell, wherein the second aperture provides access to an upper pocket portion forming a second pocket space that is part of the entirety of the lid containment volume behind the upper protruded portion and contiguous with all other portions of the lid containment volume, wherein the upper pocket portion is in part bounded by an interior surface of the upper stepped portion of the single-piece moulded concave shell and an upper pocket comprises a second fabric receptacle having a second opening with sides that are permanently affixed to the single-piece moulded lid on opposite sides of the second incision forming the second aperture so that the second fabric receptacle is contained at least in part within the upper protruded portion of the single-piece moulded concave shell.

2. The article of luggage of claim 1 wherein the lower stepped portion comprises the first aperture.

3. The article of luggage of claim 1 wherein the upper and lower stepped portions are substantially perpendicular to the lid opening plane.

4. The article of luggage claim 1 wherein the moulded concave shell further comprises a first recessed portion between the upper and lower stepped portions and set back from the upper and lower protruded portions.

5. The article of luggage of claim 4 wherein the concave moulded shell further comprises a second recessed portion that is set back from the upper protruded portion and substantially perpendicular to the lid opening plane, and a top stepped portion on an opposite side of the upper protruded portion from the upper stepped portion, wherein the second aperture is located in the top stepped portion.

6. The article of luggage of claim 1 wherein the first fabric receptacle hangs downwardly beneath the first incision.

7. The article of luggage of claim 6 wherein the first receptacle opening is closable by a first pocket zipper having a first zipper tape on the first side of the first receptacle opening and a second zipper tape on the second side of the first receptacle opening, such that both the first aperture and the fabric receptacle are openable and closable by the first pocket zipper.

8. The article of luggage of claim 6 wherein a first zipper tape is fastened to the moulded shell by stitching and a second zipper tape is fastened to the moulded shell by stitching.

9. The article of luggage of claim 6 wherein the second fabric receptacle hangs downwardly beneath the second incision.

10. The article of luggage of claim 9 wherein the first fabric receptacle and the second receptacle are spaced apart from each other and separated by a recessed portion of the moulded shell.

11. The article of luggage of claim 9 wherein the second receptacle opening is closable by an upper pocket zipper having a primary zipper tape on the first side of the second receptacle opening and a secondary zipper tape on the second side of the second receptacle opening, such that both the second aperture and the second fabric receptacle are openable and closable by the upper pocket zipper.

12. The article of luggage of claim 1 wherein, in the closed position in which the body and the lid openings cooperate such that the body and lid containment portions are enclosed, cooperation is provided by a primary zipper comprising a first tape fastened to the body proximate the body opening and a second tape fastened to the lid proximate the lid opening.

13. The article of luggage of claim 1 comprising a plurality of protruding wheel systems, each comprising at least one wheel, wherein each protruding wheel system is fastened to an exterior of the body.

14. The article of luggage of claim 13 wherein each wheel system comprises a connection element and a wheel unit, wherein the wheel unit is rotatable relative to the connection element about a generally vertical axis that sits outside a footprint of a base of the article of luggage.

15. The article of luggage of claim 1 wherein the article of luggage is in the form of a suitcase.

16. The article of luggage of claim 1, wherein the lower protruded portion and the upper protruded portion are each moulded to include at least one indentation that is spaced from and substantially parallel with the first and second incisions to provide each of the lower and upper protruded portions with a strengthening rib.

17. A method of manufacturing an article of luggage, the article of luggage comprising:

a body having an interior defining a body containment volume accessible through a body opening;

a lid comprising a single-piece moulded concave shell having an interior defining an entirety of a lid containment volume accessible through a lid opening extending in a lid opening plane;

the method comprises:

moulding the lid comprising the single-piece moulded concave shell to include:

a lower protruded portion which protrudes from the lid opening plane via a lower stepped portion;

an upper protruded portion which protrudes from the lid opening plane via an upper stepped portion that faces the lower stepped portion;

making a first incision in the moulded concave shell to provide a first aperture in the single-piece moulded concave shell that provides access to a lower pocket portion forming a first pocket space that is part of the entirety of the lid containment volume behind the lower protruded portion and contiguous with all other portions of the lid containment volume;

providing a lower pocket that comprises a first fabric receptacle having a first opening with sides that are permanently affixed to the single-piece moulded concave shell on opposite sides of the first incision forming the first aperture so that the first fabric receptacle is contained at least in part within the lower protruded portion of the single-piece moulded concave shell;

making a second incision to provide a second aperture in the single-piece moulded concave shell that provides access to an upper pocket portion forming a second pocket space that is part of the entirety of the lid containment volume behind the upper protruded portion and contiguous with all other portions of the lid containment volume, wherein the upper pocket portion is in part bounded by an interior surface of the upper stepped portion of the single-piece moulded concave shell;

providing an upper pocket that comprises a second fabric receptacle having a second opening with sides that are permanently affixed to the single-piece moulded concave shell on opposite sides of the second incision forming the second aperture so that the second fabric receptacle is contained at least in part within the upper protruded portion of the single-piece moulded concave shell;

coupling the body and the lid together to enable movement of the lid relative to the body between: an open position in which the body and lid containment volumes are accessible through the body and lid openings; and a closed position in which the body and the lid openings cooperate such that the body and lid containment portions are enclosed.

18. The method of claim 17 further comprising: fastening a first pocket zipper having a first zipper tape and a second zipper tape to the lid, wherein the first zipper tape is fastened on the first side of the first receptacle opening and the second zipper tape is fastened on the second side of the first receptacle opening, such that both the first aperture and the fabric receptacle are openable and closable by the first pocket zipper.

19. The method of claim 18 wherein any one or more of the fastening steps of the method comprises stitching.

20. The method of claim 17 wherein moulding the lid further comprises moulding the lower protruded portion and the upper protruded portion to include at least one indentation that is spaced from and substantially parallel with the first and second incisions to provide each of the lower and upper protruded portions with a strengthening rib.

* * * * *